US007628291B2

(12) United States Patent
Tasso et al.

(10) Patent No.: US 7,628,291 B2
(45) Date of Patent: Dec. 8, 2009

(54) DISPENSER FOR FLAT SHEET ARTICLES

(76) Inventors: Michael N. Tasso, 762 Robinson Drive, Sudbury, Ontario (CA) P3E 2J3; Douglas K Campbell, 5 Collins Drive, Copper Cliff, Ontario (CA) P0M 1N0; Todd J. Rooney, 3603 Errington Avenue, P.O. Box 1398, Chelmsford, Ontario (CA) P0M 1L0

( * ) Notice: Subject to any disclaimer, the term of this patent is extended or adjusted under 35 U.S.C. 154(b) by 244 days.

(21) Appl. No.: 11/645,591

(22) Filed: Dec. 27, 2006

(65) Prior Publication Data

US 2008/0156822 A1 Jul. 3, 2008

(51) Int. Cl.
*G07F 7/00* (2006.01)

(52) U.S. Cl. ..... 221/123; 221/69

(58) Field of Classification Search ..... 221/23, 221/25, 28, 34, 35, 36, 40, 41, 45, 46, 54, 221/55, 61, 68, 69, 74, 78, 80, 81–83, 85, 221/86, 89, 91, 92, 98, 99, 117, 124, 131, 221/133, 151, 152, 154, 155, 195, 198, 208, 221/215, 216, 245, 252, 270, 279, 301, 269, 221/232, 303

See application file for complete search history.

(56) References Cited

U.S. PATENT DOCUMENTS

| | | | | | |
|---|---|---|---|---|---|
| 486,201 | A * | 11/1892 | Tower | 453/47 |
| 498,832 | A * | 6/1893 | Williams | 194/257 |
| 691,990 | A * | 1/1902 | Warren | 221/131 |
| 697,661 | A * | 4/1902 | Reed | 221/94 |
| 1,624,883 | A * | 4/1927 | Allen | 221/131 |
| 1,677,938 | A * | 7/1928 | Van Sickle | 221/241 |
| 3,445,035 | A * | 5/1969 | Ackerman | 221/129 |
| 4,526,264 | A * | 7/1985 | MacNamara et al. | 194/217 |
| 4,690,303 | A * | 9/1987 | Draper et al. | 221/131 |
| 4,829,164 | A * | 5/1989 | Rudolph et al. | 235/139 R |
| 5,172,830 | A * | 12/1992 | Wu | 221/131 |
| 5,647,507 | A * | 7/1997 | Kasper | 221/151 |
| 5,857,588 | A * | 1/1999 | Kasper | 221/274 |
| 6,098,840 | A * | 8/2000 | Ito et al. | 221/232 |
| 6,382,460 | B1 * | 5/2002 | Gonzalez | 221/232 |
| 6,491,186 | B1 * | 12/2002 | Wiggins | 221/2 |
| 6,651,841 | B2 * | 11/2003 | Tsuchida | 221/251 |
| 2005/0118942 | A1 * | 6/2005 | Sugai | 453/44 |
| 2008/0128445 | A1 * | 6/2008 | Huang et al. | 221/7 |

* cited by examiner

*Primary Examiner*—Gene Crawford
*Assistant Examiner*—Kelvin L Randall, Jr.

(57) ABSTRACT

A dispenser apparatus for dispensing flat sheet articles from a stack, and having a housing, a magazine for storing the articles, a base disposed perpendicularly to the housing, the base having service portion and a delivery portion, the service portion communicating with a lower portion of the magazine, and a dispensing mechanism within the service portion of the base, in which the dispensing mechanism engages with an article at the lower portion of the magazine for advancing the article into the delivery portion of the base, and an agitator operable upon return movement of a dispensing mechanism for agitating the articles in the magazine.

6 Claims, 5 Drawing Sheets

DISPENSER FOR FLAT SHEET ARTICLES

FIELD OF THE INVENTION

The invention relates generally to a dispenser for flat sheet articles, such as cards, tickets, coupons and the like.

BACKGROUND OF THE INVENTION

A wide variety of techniques have been developed for dispensing flat sheet articles, such as lottery tickets and telephone calling cards, in retail stores. Traditionally, such articles are presented to customers in a generally flat display case positioned on a check-out counter of the retail store.

Tickets are often displayed in clear plastic box. The tickets are generally pulled from the box manually and counted by the retail store operator.

This system is time consuming for the employee, and there is a lack of control, in that employee can miscount the tickets and lose revenue.

Automated dispensers are also known. In order to function reliably in a retail store environment.

Such automated dispensing systems currently on the market are costly to purchase and costly and time consuming to repair, and bulky and difficult to install.

Accordingly, there is a need for a manually operable dispensing apparatus for reliably dispensing flat sheet articles, such as lottery tickets and calling cards. There is a further need for a dispensing apparatus that can be simply serviced and maintained to both reduce the amount of skill and training required store personell. Such a manual dispenser will also provide reliable inventory control. Moreover, there is a need for a dispensing apparatus that can be utilized to limit the likelihood of theft and to facilitate the monitoring of the inventory of flat sheet articles dispensed to customers.

BRIEF SUMMARY OF THE INVENTION

The subject invention is directed to a dispenser apparatus for dispensing one or more flat sheet articles from a stack which consists of a housing having one or more magazines for storing said one or more articles, a base disposed perpendicularly to the housing, and one or more dispensing mechanisms. The base has a service portion and a customer portion, wherein the service portion communicates with a lower region of each of the one or more magazines, and customer the portion communicates with the lower region of the base. The one or more dispensing mechanisms are located within the portion of the base and correspond to one or more magazines. The one or more dispensing mechanisms are adapted to engage with the one or more articles at the lower region of the one or more magazines for slidably advancing the one or more articles from the service portion to the customer portion of the base. An elongate bar of the dispensing apparatus is slidable between a first, a second, and a third position, wherein in the first position, the elongate bar is positioned proximate to the lower portion of the one or more magazines, wherein in the second position, the elongate bar slidably engages with the lowermost of the one or more articles, and wherein in the third position, the elongate bar slidably advances the lowermost of the one or more articles from the service portion to the customer portion of the base.

The subject invention provides a base containing one or more counter mechanisms. The counter mechanisms include a casing, a ratchet means with a pivot lever extending from the casing, and one or more numerical wheels coupled to the ratchet means and mounted within the casing, whereby the pivotal movement of the pivot lever rotatably advances at least one of the one or more numerical wheels. The one or more counter mechanisms are adapted to determine the quantity of the one or more articles slidably advanced from the service portion to the customer portion of the base, and wherein the pivot lever being pivotally moved by the slidable advancement of the elongate bar.

The subject invention is further directed to the elongate rod of the dispensing mechanism, wherein the elongate bar is formed with a handle portion and tip portion, the handle portion being operable by a service person, and the tip portion being adapted to engage with the lowermost of the one or more articles in the one or more magazines. The tip portion comprising an at least partially convex lead portion for vertically displacing the one or more articles within the one or more magazines when the elongate rod is slidably positioned between the third position and the first position. The lead portion is formed with a lip surface for engaging with the lowermost of the articles in the one or more magazines. The lip surface is dimensioned to engage and dispense the lowermost of the articles within the one or more magazines. In use, the vertical displacement of the articles by the lead portion shuffles the articles in the magazine and thus facilitates the engagement of the lowermost one of the articles by the lip surface.

The invention seeks to provide a base having a base frame, a middle plate mounted to the base frame, and a cover plate mounted to the middle plate, wherein the middle plate is provided with one or more channels disposed in parallel relationship and dimensioned to each receive one of the one or more elongate bar, and wherein the cover plate is formed with one or more cover slots adapted to register with respective the channels in the middle plate and at least partially contain the one or more elongate bar within the one or more channels. Each of the one or more channels generally defined by a bottom surface and a pair of opposed side surfaces, and wherein each of the channels is formed with a channel slot extending longitudinally along the bottom surface. Each of the channel slots have a proximal end and a distal end adapted to limit the slidabable advancement of the elongate bar between the first position, the second position and the third position. The middle plate is provided with one or more notches disposed in perpendicular relationship to the one or more channels, the one or more notches registering with the lower portion of the one or more magazines for receiving the articles.

The invention further seeks to provide a handle portion of the elongate bar is formed with a control knob for enabling the elongate rod to be slidably positioned between the first position, the second position and the third position. The handle portion is formed with a stop means for limiting the slidable advancement of the elongate bar, wherein the stop means extending at least partially downwardly through the one or more channels slots formed in the middle plate. The stop means is also adapted to pivotally actuate the counter mechanism when the elongate bar is slidably advanced along the one or more channels. Each of the control knobs extend at least partially upwardly through the one or more slots formed in the cover plate for enabling the one or more elongate bar to be slidingly advanced longitudinally along the one or more channels.

The invention further provides one or more magazines formed with a rear wall, two opposed side walls and a front wall extending generally vertically, wherein the rear wall is spaced apart from the front wall to form an open space for receiving the stack of the one or more articles. The front wall is at least partially transparent to enable the viewing of the one or more articles within the one or more magazines of the housing. The front wall may be removed from the housing to permit the one or more magazines to be replenished with additional the one or more articles. In a further embodiment, the front wall is adapted to receive and display one or more advertisement sheets relating to the one or more articles with the one or more magazines.

IN THE DRAWINGS

For a better understanding of the present invention, and to show more clearly how it may be carried out in practice, reference will now be made, by way of example only, to the accompanying drawings, in which.

DESCRIPTION OF A SPECIFIC EMBODIMENT

The invention is illustrated with reference to FIGS. 1-7 which show a dispenser apparatus (10) for dispensing one or more flat sheet articles (A) from a stack. Dispenser apparatus (10) may be suitably used in a retail or convenience store to dispense a wide variety of flat sheet articles, such as lottery and gaming cards, stamp booklets and the like.

Figure 1:
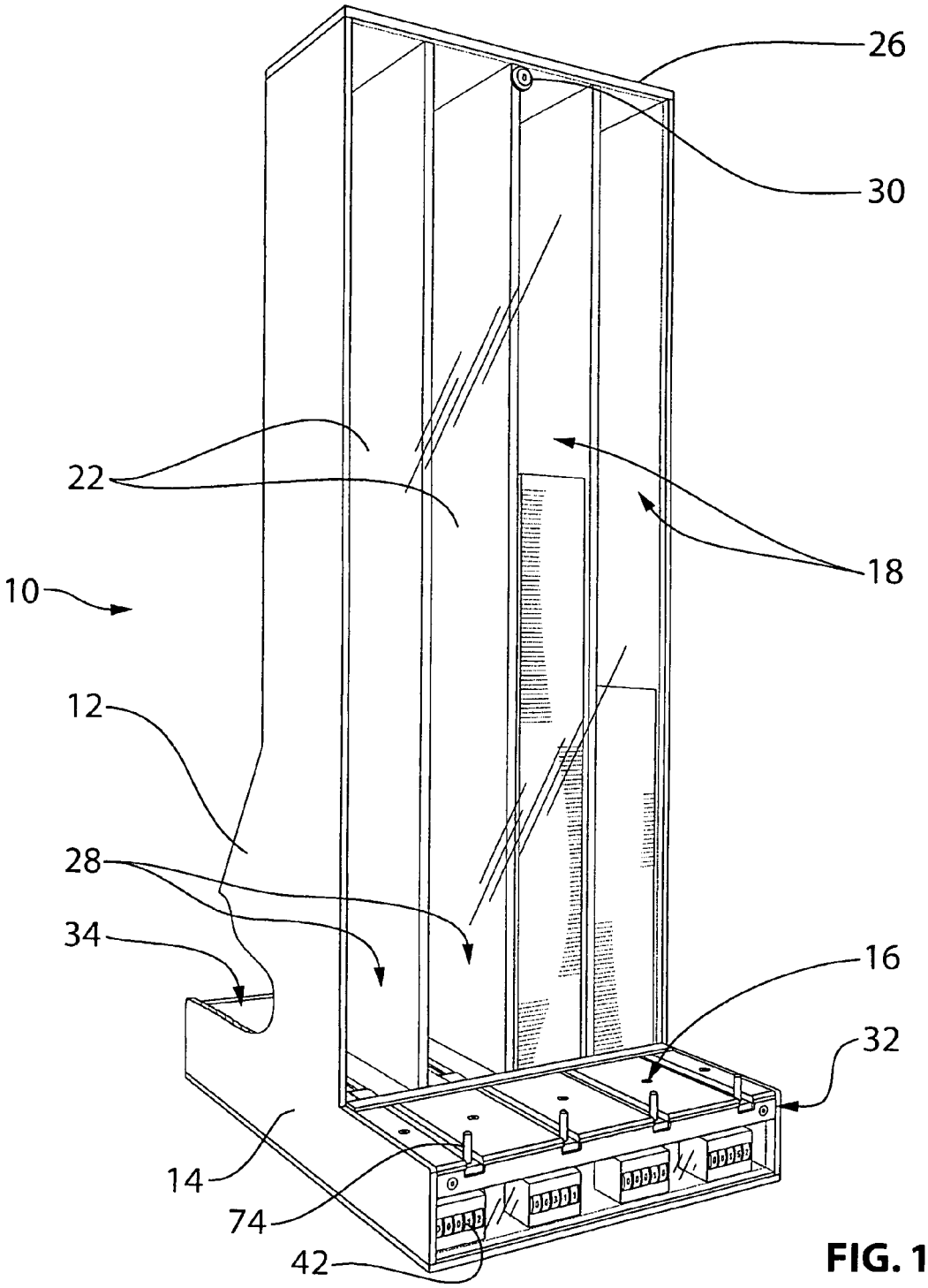
FIG. 1 is a front perspective view of a dispenser apparatus illustrating a preferred embodiment of the present invention containing stacks of flat sheet articles.
Figure 2:
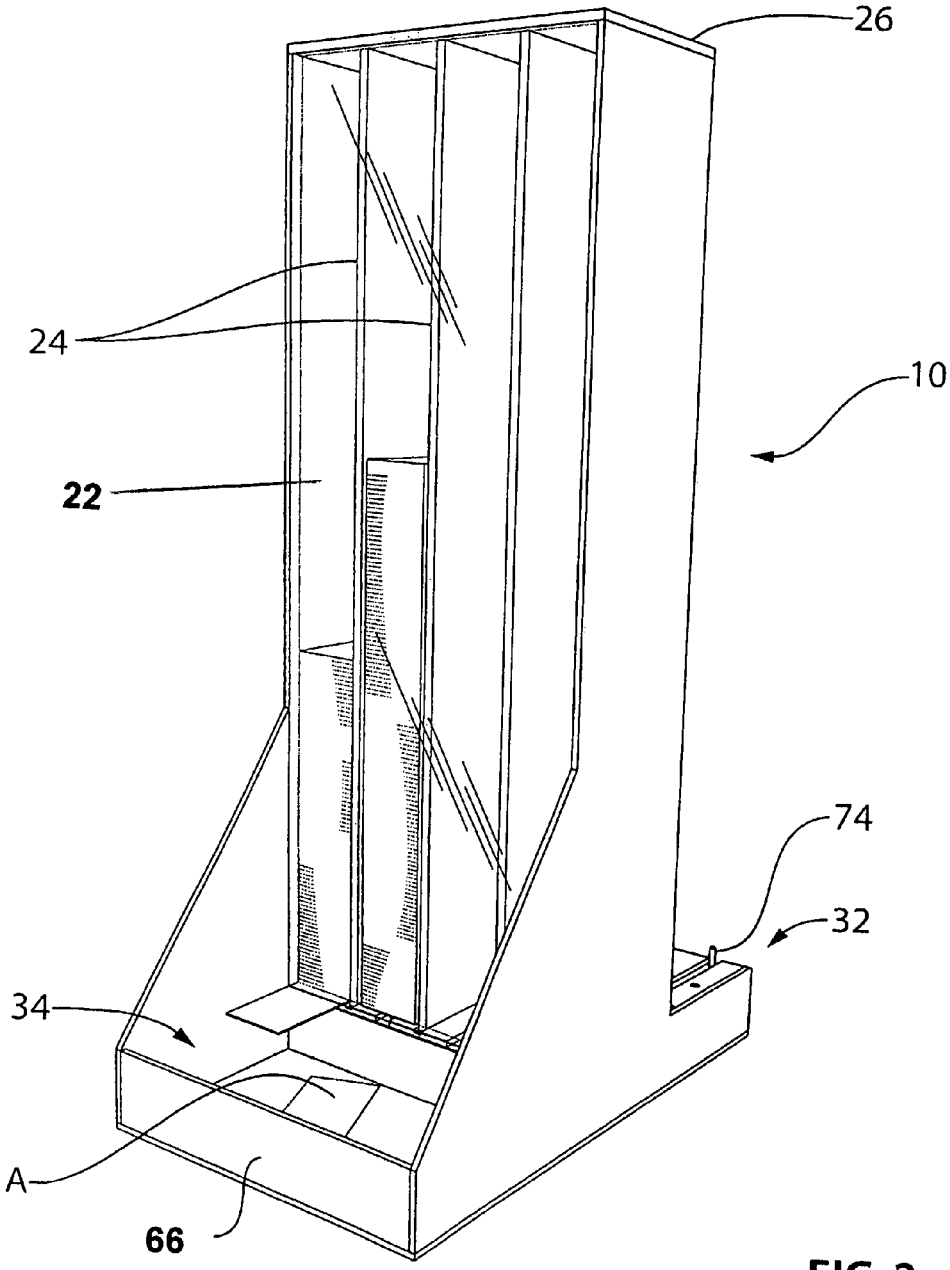
FIG. 2 is a rear perspective view of said dispenser apparatus shown in FIG. 1.

The dispenser apparatus (10) comprises a housing (12) for storing the articles (A), a base (14) disposed perpendicularly beneath housing (12), and one or more dispensing mechanisms (16) for dispensing the articles (A) from the housing (12). Housing (12) includes one or more magazines (18) for storing and displaying the articles (A) to a customer. As shown in FIGS. 1 and 2, each magazines (18) is formed with a fixed wall (20), a access wall (22) and two opposed side wall (24) secured to the fixed wall (20). The access wall (22) is spaced apart from the fixed wall (20) to form a generally rectangular tube for each of the magazines (18). The articles (A) to be dispensed within each of the magazines (18) are stacked generally horizontally one above one another. Each of the magazines (18) have a closed top end (26) and an open bottom aperture (28) for enabling the dispensing of the articles (A) using the dispensing mechanisms (16).

Referring to FIGS. 1 and 2, the fixed and access walls (20) and (22), respectively, are at least partially transparent to enable a person to view the articles (A) within the magazines (18). It should be understood by a person skilled in the art that any suitable transparent material may be utilized to form the walls (20) and (22), respectively, such as, for example, a sheet of glass, plexiglass or plastic. Alternatively, each of walls (20) and (22) may be adapted to receive and display advertisement sheets (not shown) relating to said articles with in said magazines (18). The access wall (22) may be removed from the magazine (18) to permit of the magazines (18) to be replenished with additional flat sheet articles (A). As shown in FIG. 1, a locking means (30) may be provided on a top portion of the access wall (22) to enable a service person, such as store manager, to access the magazines (18).

Referring again to FIGS. 1 and 2, base (14) is disposed perpendicularly to the housing (12) and includes a service portion (32) and a delivery portion (34). The delivery portion (34) is accessible by a purchaser to retrieve articles (A) which have been dispensed from the dispensing mechanism (16). As will be discussed in greater detail below, the service portion (32) is in communication with the bottom aperture (28) so as to receive article (A) from each of the magazines (18).

Figure 3:
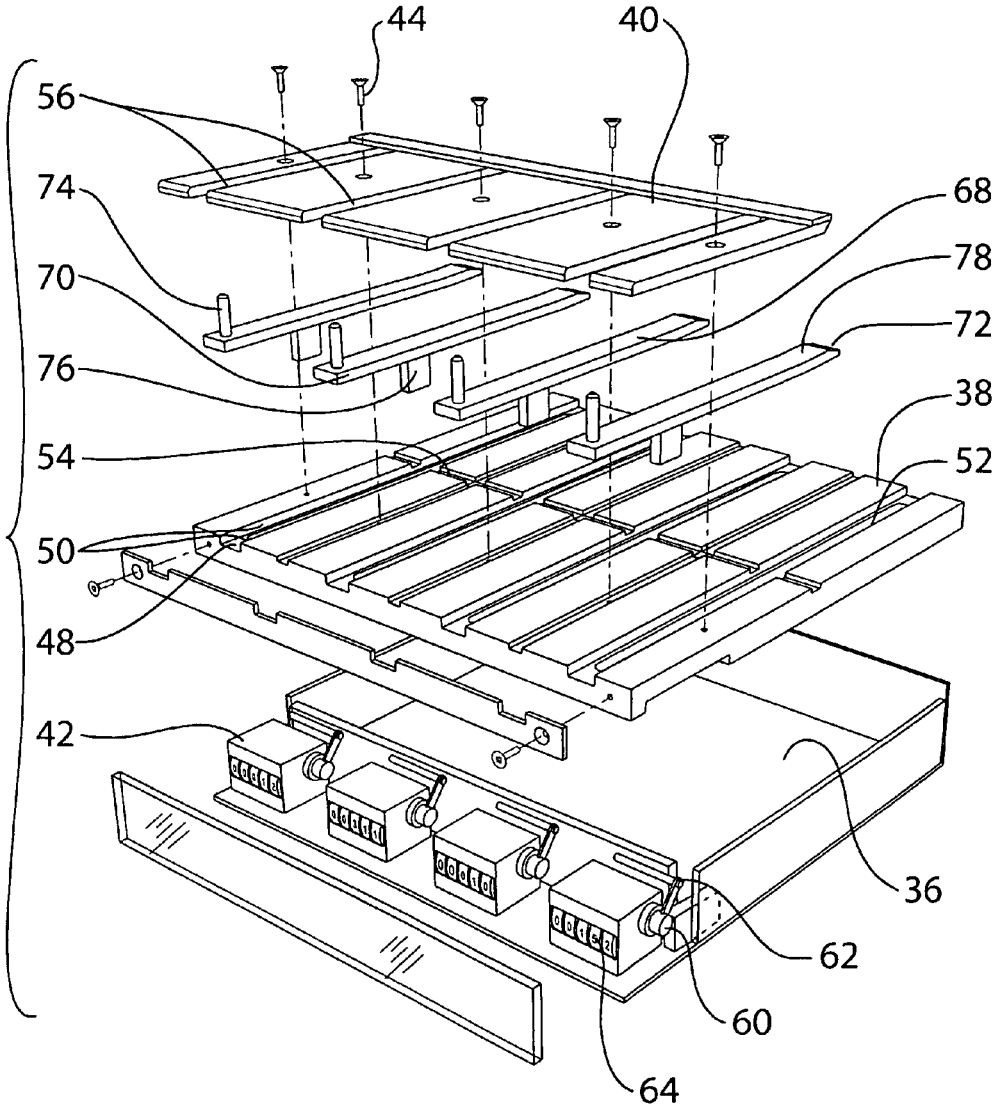
FIG. 3 is an exploded perspective view of an operating portion of the dispenser apparatus shown in FIG. 2.

Referring to FIG. 3, the service portion (32) of the base (14) includes a base frame (36), a middle plate (38) mounted to the base frame (36), a cover plate (40) mounted to the middle plate (36), and one or more counter mechanisms (42). The base frame (36) is designed to support the dispensing mechanism (16) and may be made of aluminum or other similar material. The middle plate (38) is mounted within the base frame (36) using suitable fasteners (44) and is formed with one or more channels (46) disposed in parallel relationship along the length of the middle plate (38). Each of said one or more channels (46) are generally defined by a bottom surface (48) and a pair of opposed side surfaces (50). Each of the bottom surfaces (48) are provided with a channel slot (52) which extends longitudinally from a proximal end to a distal end of the channel (46). The middle plate (38) is further provided with notches (54) disposed in perpendicular relationship to each of channels (46). The notches (54) are adapted to register with the corresponding bottom apertures (28 ) on the lower portion of each of the magazines (18).

The cover plate (40) is formed with cover slots (56) which are adapted to register with the corresponding channels (46) provided in the middle plate (38). The cover plate (40) may be mounted to the middle plate (38) using suitable fasteners so as to at least partially contain the dispensing mechanisms (16) in the channels (46)

The counter mechanisms (42) are mounted to the base frame (36) and include, a ratchet means (60) with a pivot lever (62), and one or more numerical wheels (64) coupled to said ratchet means (60). Pivotal movement of the pivot lever (62) rotatably advances at least one of said numerical wheels (64) for determining the quantity of the articles (A) dispensed to the delivery portion (34).

The delivery portion provides walls (66) defining a generally rectangular trough. This is located so as to receive an article, when it is dispensed from a magazine.

Figure 4:
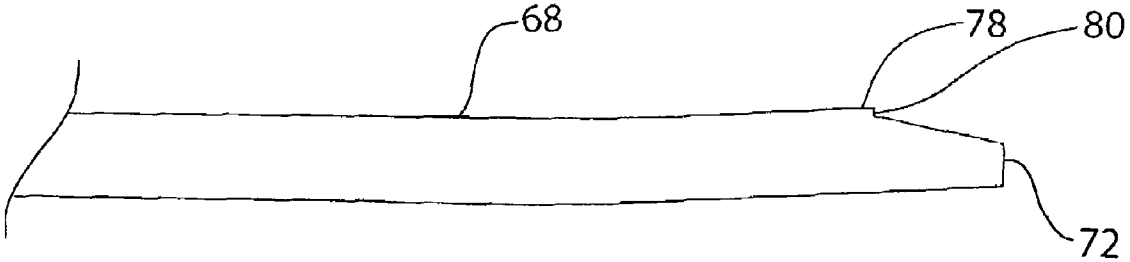
FIG. 4 is an enlarged side elevation of part of an elongated rod of said operating portion in FIG. 3.
Figure 5:
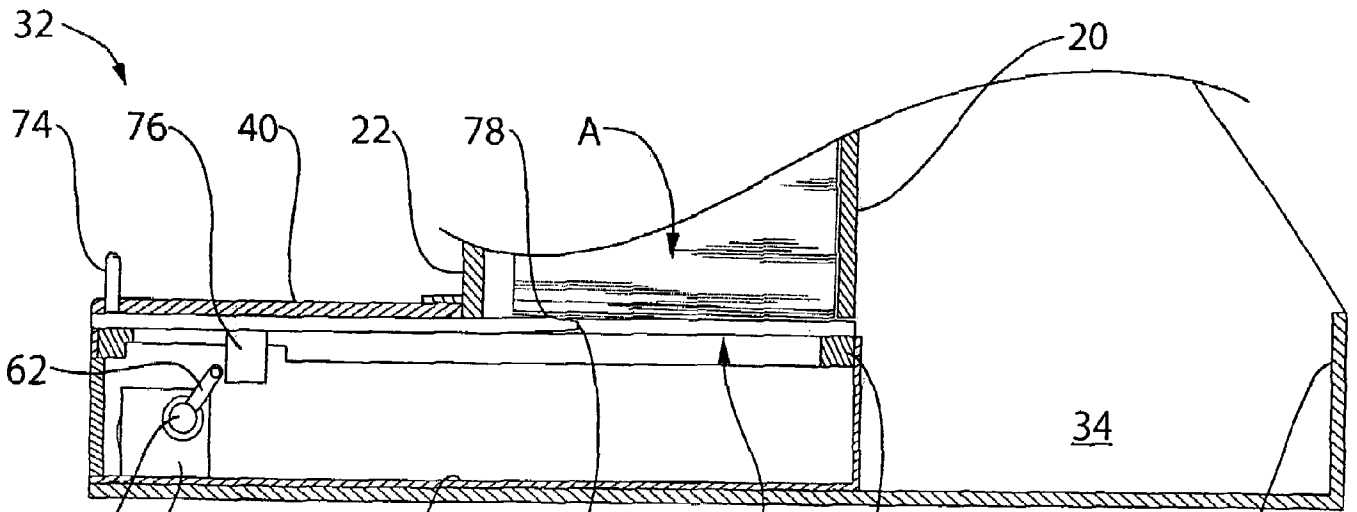
FIG. 5 is a partial side elevation view of said dispenser apparatus showing the elongate bar in first position beneath said articles.

Referring to FIGS. 4 and 5, each of the dispensing mechanisms (16) includes an elongate bar (68). The elongate bar (68) includes a handle portion (70) and a tip portion (72). The handle portion (70) includes a control knob (74) and a stop means (76). The control knob (74) extends at least partially upwardly through the corresponding one of slots (56) formed in the cover plate (40) for enabling a service person to slidably move the elongate bar (68) longitudinally along the corresponding channel (46) in the middle plate (38). Each of the stop means (76) extend at least partially downwardly through the channel slots (52) formed in the middle plate (38) and are adapted to engage with the proximal and distal ends, respectively, of the channel slots (52) to limit the extent of longitudinal movement of the elongate bar (68). The stop means (76) are also positioned to pivotally actuate the corresponding counter mechanism (42) when the elongate bar (68) is slidably advanced along the channel (46) and prior to actual engagement, and delivery of an article (A) to the delivery portion (34).

As shown in FIG. 4, the tip portion (72) of the elongate bar (68) includes an at least partially convex agitator surface portion (78) raised upwardly from the upper surface of the elongate bar for vertically displacing articles (A) within the magazines (18) when the corresponding elongate bar (68) is slidably moved along the channel (46). The agitator portion (78) is formed with a raised lip surface (80) for engaging with the lowermost of the articles (A) within a magazine (18). The lip surface (80) is dimensioned to engage and dispense only the lowermost of said articles (A) within said magazine (18). The convex agitator portion (78) momentarily causes, the vertical displacement of the articles (A) within the magazine (18) shuffling or agitating the articles (A). This ensure that the articles (A) do not become jammed in the magazines (18).

In use, when a customer wishes to purchase a ticket the elongate bar (68) of the dispensing mechanism (16) is slidably moved by a store clerk between a first, a second, and a third position to dispense an article (A) from one of the magazines (18).

In the first position shown in FIG. 5, each of the elongate bars (68) is positioned proximate to the lower end of the magazines (18).

Figure 6:
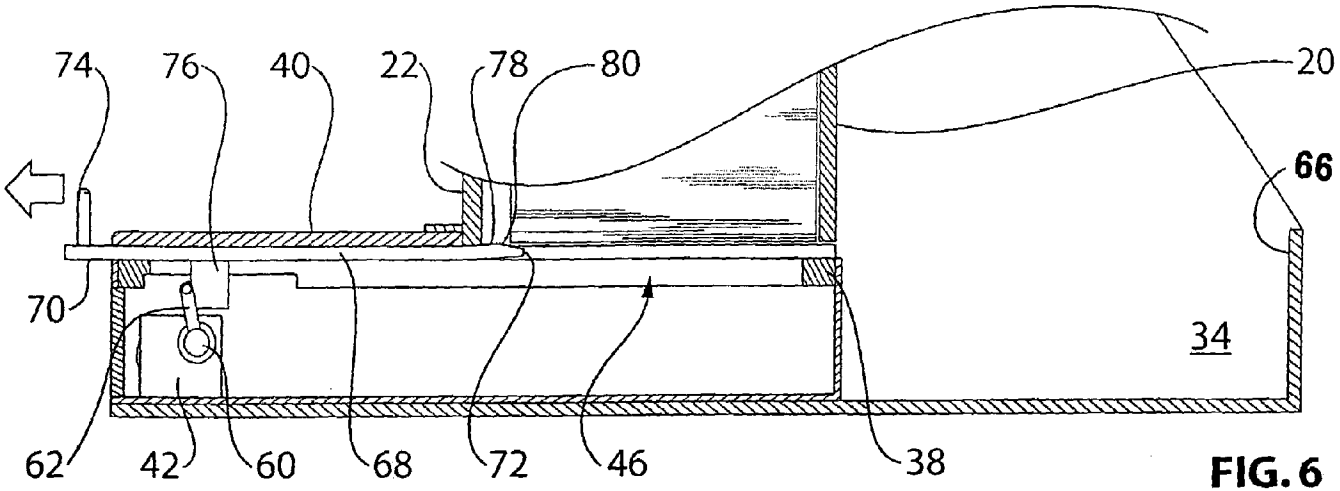
FIG. 6 is a partial side elevation view of said dispenser apparatus showing said elongate bar being slidably actuated into a second position and engaging with a counter mechanism.

In the second position shown in FIG. 6, of the elongate bar (68) are slidably moved forwardly resulting in the lip (80) on tip portion (72) engaging with the lowermost article (A) within the corresponding magazine (18).

Figure 7:
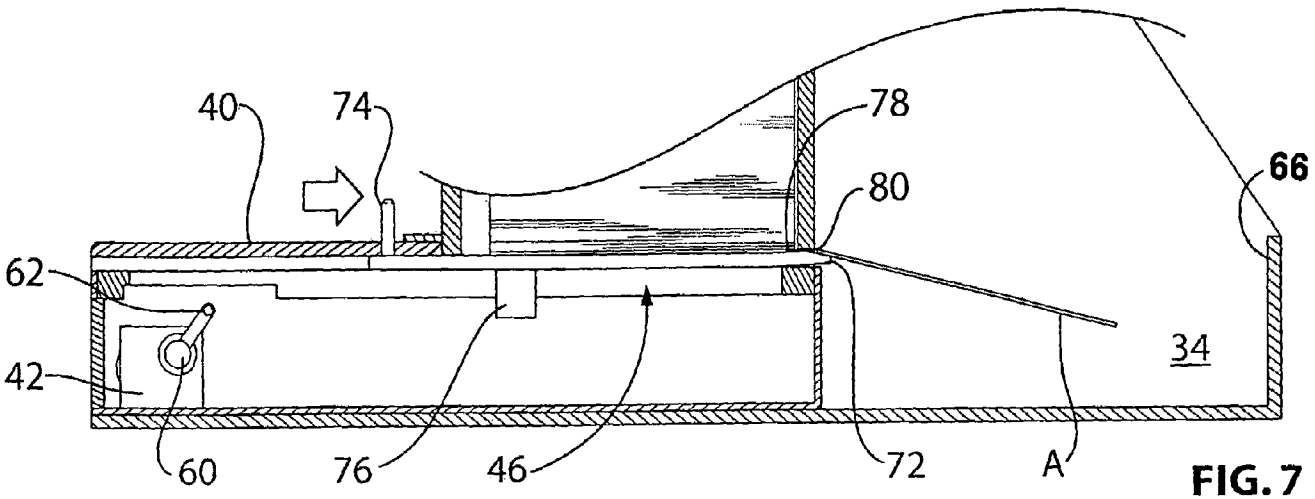
FIG. 7 is a partial side elevation view of said dispenser apparatus showing said elongate bar being slidably actuated into a third position and dispensing a flat sheet article.

In the third position shown in FIG. 7, the elongate bar (68) is slidaby moved in the third position to engage the lowermost of the articles (A) within the corresponding magazine (18). Upon movement of the elongate bar (68) between the second and third position, the lowermost article (A) within the magazine (18) is slidingly advanced along the channel (46) and dispensed into the delivery portion (34) of the base (16) to be received by a customer. The return movement of the elongate bar (68) from the third position to the first position then causes the convex surface portion (78) of the elongate bar (68) to vertically displace or shift the articles (A) within the magazine (18) upwardly and then downwardly. This vertical displacement or shifting of the articles (A) within the magazine (18) after each dispensing process agitates articles (A) and substantially eliminates the likelihood of the articles (A) becoming jammed within the magazine (18) and readies the next lowermost article within the respective magazine (18) for dispensing.

It should also be noted that the lowermost article cannot be dispensed until the counting mechanism is engaged to count 1 unit.

In operation in a retail store environment, the dispensing apparatus (10) is filled with articles (A), such as lottery tickets or calling cards. A customer indicates the quantity of articles they wish to purchase. The stone clerk moves the corresponding elongate bar (68) between the first, second and then third positions to dispense the article (A) into the delivery portion (34) of the base (14) for retrieval by the customer. As the elongate bars (68) are repositioned back to the second position from the third position, the articles (A) within the corresponding magazines (18 ) are displaced or shifted by the convex leading portion (78) of the elongate rod (68) to ready the next lowermost article for dispensing to the next consumer. When it is necessary to refill the one or more magazines (18), the store clerk simply unlocks the locking means (30) on the wall (22) to enable the magazine (18) to be replenished with articles (A). Once the magazine (18) has been replenished, the access wall (22) may be repositioned in the housing and secured in placed using the locking means (30). The counter mechanisms (42) are actuated by the slidable movement of the elongate bars (68) and provide the retail store owner with a count of the number of articles (A) dispensed from each of the magazines (18). This enables the retail store owner to accurately monitor the inventory of articles (A) for accounting and theft prevention purposes.

When the bar (68) is returned to its initial position, the stop (76) will simply trip the lever (62) without operating the counting device.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dispenser apparatus for dispensing one or more flat sheet articles from a stack, said dispenser apparatus comprising:

a housing having at least one magazine for storing said articles;

a base disposed perpendicularly to said housing, said base having a service portion on one side and a delivery portion on another side opposite to said service portion, said service portion communicating with a lower portion of each of said magazines;

at least one dispensing mechanism within said service portion of said base, corresponding to a respective said magazine, and an elongate bar included in said dispensing mechanism for engaging with one of said articles of a said magazine for slidably advancing one of said articles from said service portion to said delivery portion of said base, said elongate bar having a handle portion and tip portion, said handle portion being operable by a service person, and said tip portion being adapted to engage with the lowermost of said articles in a said magazine;

said elongate bar being slidable between a first, a second, and a third position, wherein in said first position, said elongate bar is positioned proximate to said lower portion of said one or more magazines, wherein in said second position, said elongate bar slidably engages with the lowermost one of said articles, and wherein in said third position, said elongate bar slidably advances the lowermost one of said articles from said service portion to said delivery portion of said base;

and a convex upstanding agitator surface on said elongate bar for engaging and vertically displacing said articles within said magazine when said elongate bar is slidably positioned between said third position and said first position wherein said dispensing mechanism further comprises a base frame, a middle plate mounted to said base frame, and a cover plate mounted to said middle plate, wherein said middle plate is provided with at least one channel disposed in parallel relationship and dimensioned to each receive a said elongate bar, and wherein said cover plate has a cover slot adapted to register with respective said channels in said middle plate and at least partially contain said elongate bar within said channel.

2. The dispensing apparatus as defined in claim 1, wherein each of said channels is generally defined by a bottom surface and a pair of opposed side surfaces, and wherein each of said channels has a channel slot-extending longitudinally along said bottom surface.

3. The dispensing apparatus as defined in claim 1, wherein each of said channel slots has a proximal end and a distal end to limit the slidabable advancement of said elongate bar between said first position, said second position and said third position.

4. The dispensing apparatus as defined in claim 2, wherein said middle plate is provided with at least one notch disposed in perpendicular relationship to said one or more channels, said notch registering with said lower portion of a said magazine for receiving said articles.

5. The dispensing apparatus as defined in claim 4, wherein said handle portion comprises a stop means for limiting the slidable advancement of said elongate bar, wherein said stop means extends at least partially downwardly through a said channel slot formed in said middle plate.

6. The dispensing apparatus as defined in claim 5, wherein said stop means is adapted to actuate said counter mechanism when said elongate bar is slidably advanced along said channel.

* * * * *